US010378501B2

(12) United States Patent
Sarwar et al.

(10) Patent No.: US 10,378,501 B2
(45) Date of Patent: Aug. 13, 2019

(54) SYSTEMS AND METHOD FOR PERFORMING PROGNOSIS OF FUEL DELIVERY SYSTEMS USING SOLENOID CURRENT FEEDBACK

(71) Applicant: GM GLOBAL TECHNOLOGY OPERATIONS LLC, Detroit, MI (US)

(72) Inventors: Azeem Sarwar, Rochester Hills, MI (US); Chaitanya Sankavaram, Sterling Heights, MI (US); Xiangxing Lu, Sterling Heights, MI (US); Syed B Mehdi, Farmington Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 82 days.

(21) Appl. No.: 15/834,099

(22) Filed: Dec. 7, 2017

(65) Prior Publication Data

US 2019/0178215 A1 Jun. 13, 2019

(51) Int. Cl.
*F02M 65/00* (2006.01)
*F02D 41/30* (2006.01)
*F02M 59/46* (2006.01)

(52) U.S. Cl.
CPC ..... *F02M 65/00* (2013.01); *F02D 41/3082* (2013.01); *F02M 59/466* (2013.01)

(58) Field of Classification Search
CPC ..... F02D 41/30; F02D 41/3082; F02M 59/46; F02M 59/466; F02M 65/00
USPC ..... 123/495, 497–499; 701/104, 107, 112, 701/114; 73/114.38, 114.41
See application file for complete search history.

(56) References Cited

U.S. PATENT DOCUMENTS

| | | | |
|---|---|---|---|
| 7,159,623 | B1 | 1/2007 | Carr et al. |
| 7,735,476 | B2 | 6/2010 | Carr et al. |
| 8,055,460 | B2 | 11/2011 | Rajagopalan et al. |
| 8,433,672 | B2 | 4/2013 | Shin et al. |
| 2009/0185915 | A1* | 7/2009 | Sanger ..... F04B 9/117 417/46 |

(Continued)

OTHER PUBLICATIONS

Burkhard, J., "Individual Cylinder Fuel Control for a Turbocharged Engine," SAE Technical Paper 2014-01-1167, doi:10.4271/2014-01-1167.

*Primary Examiner* — John Kwon
*Assistant Examiner* — Johnny H Hoang

(57) ABSTRACT

An engine fuel delivery system, prognosis system, and method of conducting a fuel pump solenoid prognosis are provided. The engine fuel delivery system includes a fuel pump having a pumping chamber, a closeable inlet valve (such as a fuel pump control solenoid), and a fuel rail to communicate pressurized fuel received from the fuel pump to at least one engine cylinder. The engine fuel delivery system, prognosis system, and method are configured to determine a solenoid current feedback of a fuel pump control solenoid and a variation in the feedback. The fuel delivery system, prognosis system, and method are further configured to indicate a potential solenoid electrical connection fault if the solenoid current feedback is less than a predetermined current threshold and less than a predetermined variation threshold, and to indicate a potential solenoid weakened electromagnetic field fault if the solenoid current feedback is greater than the predetermined variation threshold.

20 Claims, 6 Drawing Sheets

(56) References Cited

U.S. PATENT DOCUMENTS

| | | | | |
|---|---|---|---|---|
| 2015/0090227 | A1* | 4/2015 | Pursifull | F02M 59/366<br>123/446 |
| 2017/0037805 | A1* | 2/2017 | Anetsberger | F02D 41/22 |
| 2017/0298883 | A1* | 10/2017 | Sarwar | F02D 41/3845 |
| 2017/0350340 | A1 | 12/2017 | Sarwar et al. | |

* cited by examiner

SYSTEMS AND METHOD FOR PERFORMING PROGNOSIS OF FUEL DELIVERY SYSTEMS USING SOLENOID CURRENT FEEDBACK

TECHNICAL FIELD

The present disclosure relates to vehicle powertrain fuel delivery, and more particularly, to prognosis of valves for controlling fuel delivery.

INTRODUCTION

Stricter emission regulations and increasing fuel economy requirements have been among the key driving forces that have led the automotive industry to constantly improve the efficiency of gasoline engines and to innovate to reduce harmful exhaust gas emissions. In prior years, port fuel injection (PFI) engines represented the state-of-the-art for production gasoline engines. In PFI engines, a plurality of fuel injectors deliver gasoline adjacent to each intake valve, and the fuel then mixes with incoming air and gets pulled into each combustion chamber when each intake valve opens. However, increasingly stringent fuel economy and emissions standards have prompted the use of spark ignition direction injection (SIDI) engines. In SIDI engines, fuel is injected directly into each combustion chamber at a high pressure during the compression stroke, reducing wall wetting and hence improving cold start hydrocarbon emissions. Direction injection (SIDI technology) reduces throttling loss of the gas exchange by stratified and homogenous lean operation, enables higher thermal efficiency by stratified operation and increased compression ratio, decreases the fuel consumption and $CO_2$ emissions, lowers heat losses, enables fast heating of the catalyst by injection during the gas expansion phase, increases performance and volumetric efficiency due to cooling of air charge, and enables better cold start performance.

In SIDI engines, however, a carbon and/or dirt build-up may occur in the intake valves that reduces the airflow to the cylinders over time because fuel (containing cleaners) is no longer being sprayed into the intake valves. Breaking off of the built-up dirt or carbon can cause failure. In addition, failure of other SIDI components can cause the system to fail or to operate poorly. It is therefore desirable to diagnose problems with the fuel intake system prior to such failures.

SUMMARY

The present disclosure provides a fuel delivery system, prognosis system, and method for conducting fuel pump prognosis that identifies an issue with the fuel pump control valve by monitoring current feedback and making a determination as to the mode of failure based on examining the current feedback. If the current feedback is low, a suspected bad electrical connection is indicated; and if the current feedback has a large peak-to-peak variation, a suspected weakened electromagnetic field is indicated.

In one form, which may be combined with or separate from the other forms disclosed herein, a method of conducting a fuel pump solenoid prognosis is provided. The method includes determining a solenoid current feedback of a fuel pump control solenoid and determining whether the solenoid current feedback is less than a predetermined low current threshold. The method further includes determining a magnitude of variation of the solenoid current feedback and determining whether the magnitude of variation of the solenoid current feedback exceeds a predetermined variation threshold. The method includes indicating a potential solenoid electrical connection fault if the solenoid current feedback is less than the predetermined low current threshold and less than the predetermined variation threshold; and the method includes indicating a potential solenoid weakened electromagnetic field fault if the solenoid current feedback is greater than the predetermined variation threshold.

In another form, which may be combined with or separate from the other forms disclosed herein, a fuel delivery system is provided that includes a fuel pump having a pumping chamber and a closeable inlet valve and a fuel rail configured to communicate pressurized fuel received from the fuel pump to at least one engine cylinder. A control system comprises a memory and an instruction set, where the instruction set is executable to: determine a current feedback of the closeable inlet valve; determine whether the current feedback is less than a predetermined low current threshold; determine a magnitude of variation of the current feedback; determine whether the magnitude of variation of the current feedback exceeds a predetermined variation threshold; indicate a potential valve electrical connection fault if the current feedback is less than the predetermined low current threshold and less than the predetermined variation threshold; and indicate a potential valve weakened electromagnetic field fault if the current feedback is greater than the predetermined variation threshold.

In yet another form, which may be combined with or separate from the other forms disclosed herein, a direct-inject fuel pump prognosis system is provided that includes a memory and an instruction set. The instruction set is executable to: determine a current feedback of a closeable inlet valve; determine a mean current based on the current feedback; determine whether the current feedback and/or the mean current is less than a predetermined low current threshold; determine a magnitude of variation of the current feedback; determine whether the magnitude of variation of the current feedback exceeds a predetermined variation threshold; determine whether the mean current is greater than a predetermined high current threshold; indicate a potential valve electrical connection fault if the current feedback is less than the predetermined low current threshold and less than the predetermined variation threshold; and indicate a potential valve weakened electromagnetic field fault if the current feedback is greater than the predetermined variation threshold and/or if the mean current is greater than the predetermined high current threshold.

Further additional features may be provided, including but not limited to the following: the control system, prognosis system, and method being configured to determine the solenoid current feedback by measuring an amount of current flowing through the fuel pump control solenoid (or closeable inlet valve) at a range of operating conditions and normalizing the amount of current flowing through the fuel pump control solenoid (or closeable inlet valve) against the range of operating conditions; the control system, prognosis system, and method being configured to determine a plurality of control signal adjustment gain values applied to a control signal for controlling the fuel pump control solenoid (or closeable inlet valve) and normalize the plurality of control signal adjustment gain values against the range of operating conditions to define a set of normalized control signal adjustment gain values; the control system, prognosis system, and method being configured to indicate a deviating control signal adjustment if any normalized control signal adjustment gain value of the set of normalized control signal adjustment gain values lies outside of a predetermined desired gain range and to indicate a normal control signal adjustment if the set of normalized control signal adjustment gain values lies inside of the predetermined desired gain range; and the control system, prognosis system, and method being configured to indicate a potential bad current sensing fault if the normal control signal adjustment is indicated and at least one of the potential solenoid electrical connection fault and the potential solenoid weakened electromagnetic field fault is indicated.

Further additional features may be included, including but not limited to the following: wherein determining the solenoid current feedback includes calculating a mean and a standard deviation of a difference between an actual solenoid current feedback signal and an expected solenoid current feedback signal; the control system, prognosis system, and method being configured to energize the fuel pump control solenoid (or the closeable inlet valve) to hold the fuel pump control solenoid closed during a hold timeframe and deenergize the fuel pump control solenoid (or the closeable inlet valve) to begin a solenoid off timeframe; and wherein determining the solenoid current feedback is performed at one of the following times: a) at the start of the solenoid off timeframe; and b) during the hold timeframe.

Additional further details may be provided, including but not limited to the following: the control system, prognosis system, and method being configured to issue a potential solenoid electrical connection fault warning message if the potential solenoid electrical connection fault is indicated, issue a potential solenoid weakened electromagnetic field fault warning message if the potential solenoid weakened electromagnetic field fault is indicated, and/or issue a potential bad current sensing fault warning message if the potential bad current sensing fault is indicated; the fuel delivery system further comprising a low-pressure supply pump configured to provide fuel to the (high pressure) fuel pump; the control system, prognosis system, and method being configured to determine whether a mean current is greater than a predetermined high current threshold; and the control system, prognosis system, and method being configured to indicate the potential solenoid weakened electromagnetic field fault if the mean current is greater than the predetermined high current threshold.

DETAILED DESCRIPTION

Embodiments and examples of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ aspects of the present disclosure. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
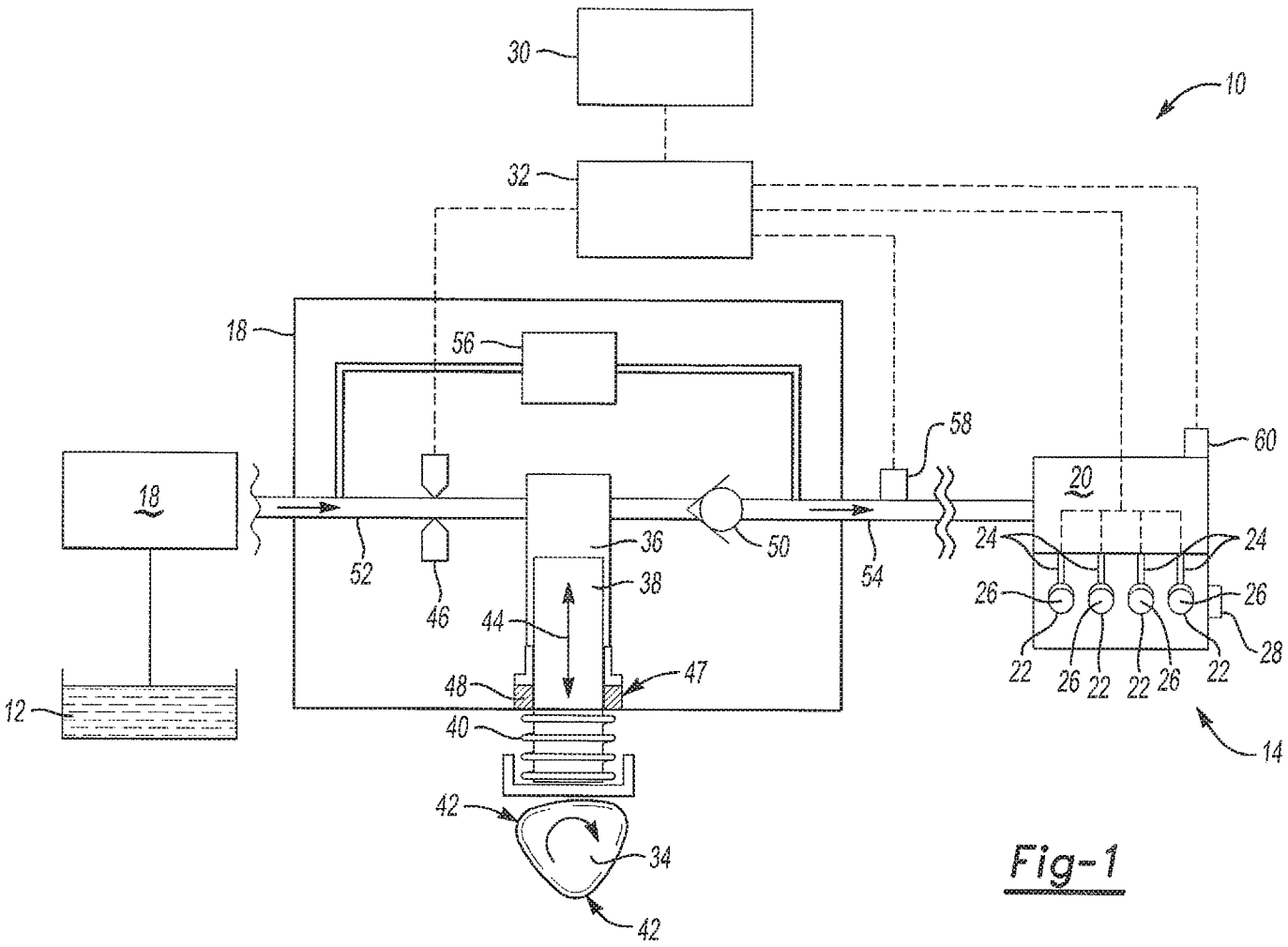
FIG. 1 is a schematic view of a fuel delivery system, in accordance with the principles of the present disclosure.

Referring to FIG. 1, an internal combustion engine fuel delivery system 10 provides fuel for an engine 14. The fuel delivery system 10 may provide fuel to the engine 14 in the form of gasoline and/or ethanol in various percentages. In the example provided, the fuel delivery system 10 is a high-pressure direct injection system. Fuel is pressurized prior to delivery to the engine 14. A low-pressure fuel supply pump 16 draws fuel from a reservoir portion of the fuel tank 12 to supply the fuel to a high-pressure fuel pump 18. A pressure rise is created within the high-pressure pump 18 and the pressurized fuel is communicated through a fuel rail 20 to each of a plurality of cylinders 22 of the engine 14. While FIG. 1 depicts four cylinders 22 as a representation, the engine 14 may include any number of cylinders 22 based on the engine configuration. A plurality of cylinders 22 may be arranged in separate groups, or banks. Alternatively, the cylinders 22 may be arranged in an inline orientation as shown.

Each cylinder 22 receives pressurized fuel from the fuel rail 20 and the fuel is dispersed into the cylinder by a fuel injector 24. Air is also supplied to each cylinder 22 through an air valve (not shown) to be mixed with the pressurized fuel to create a desirable fuel-to-air ratio to facilitate optimal fuel combustion. The combustion within each cylinder 22 drives a piston 26 which in turn rotates a crankshaft 28 to output torque from the engine 14.

In the illustrated example, the engine 14 is a spark ignition direction injection (SIDI) engine. Pressurized fuel from each injector 24 is directly sprayed into a corresponding cylinder 22 to mix with air once inside of the cylinder 22 as opposed to being pre-mixed before injection. Direct injection of pressurized fuel into the cylinders 22 enhances the ability to send precise amounts of fuel to the cylinders 22 at exact timing intervals.

The high-pressure pump 18 may generate fuel pressure delivered to the fuel rail 20 at up to about 2,500 psi (in some examples, the pressure may be in a range of 1 to 20 MPa). The high-pressure fuel pump 18 is driven by a camshaft 34 and is operable to vary the fuel output to satisfy engine demand. The camshaft 34 is mechanically linked to the crankshaft 28 such that the rotational speed of the camshaft 34 is related to the rotations per minute (RPM) of the output of the crankshaft 28 of the engine 14.

The various fuel delivery components discussed herein may have one or more associated controllers to control and monitor operation. Controller 32, although represented as a single controller, may be implemented as one controller, or as system of controllers in cooperation to collectively manage fuel delivery. Multiple controllers may be in communication via a serial bus (e.g., Controller Area Network (CAN)) or via discrete conductors. In further examples, at least a portion of the control function is performed by an off-board processing element which is external to the vehicle. The controller 32 is programmed to coordinate the operation of the various fuel delivery components. The fuel demand of the engine 14 required to output torque varies based at least on driver demand indicated by input at an accelerator pedal 30. An accelerator pedal sensor provides a pedal position signal to the controller 32. In addition, or in the alternative, such as in the case of an autonomous or self-driving vehicle, throttle position information may be provided to the controller 32 in lieu of a pedal position influenced by a driver. The controller 32 also monitors operating conditions of the low-pressure supply fuel pump 16, the high-pressure fuel pump 18, fuel rail 20, fuel injectors 24, and/or the cylinders 22. The low-pressure fuel supply pump 16 may include sensors to provide the controller 32 with information regarding the amount of fuel supplied to the high-pressure fuel pump 18. The high-pressure fuel pump 18 includes one or more sensors, discussed in more detail below, which provide feedback information to the controller 32 regarding pump operation. Fuel outlet pressure may be measured by a pressure sensor directly at the outlet of the high-pressure pump 18. The controller 32 may also be in communication with one or more additional pressure sensors 60 along the fuel rail 20 to monitor fuel pressure at other locations in the fuel delivery system 10. In addition, the controller 32 may determine the desired fuel pressure for delivery to the engine 14 as a pressure set point.

The high-pressure pump 18 may be a standalone unit that is mechanically actuated. The high-pressure fuel pump 18 includes a pumping chamber 36 configured to accumulate a pressure rise in fuel within the chamber 36. The high-pressure pump 18 may be directly or indirectly driven by engine output (e.g., crankshaft 28). In the illustrated example, the camshaft 34 drives the high-pressure pump 18, which is operatively coupled to the output rotation (e.g., crankshaft 28) of the engine 14. A plunger 38 is biased against the camshaft 34 by a spring 40. The rotation of the camshaft 34 actuates the high-pressure fuel pump 18 when one or more lobes 42 of the camshaft 34 reciprocally actuate the plunger 38 along an actuation direction depicted by arrow 44. In one example, the camshaft 34 defines a three-lobe cam such that the high-pressure fuel pump 18 cycles at a proportionally higher rate relative to output RPM of the engine crankshaft 28. As the plunger 38 moves, the available volume within the pumping chamber 36 changes, either allowing fuel to be drawn in, or forcing fuel to be expelled following the pressure rise. In alternate examples, the high-pressure pump 18 may be driven by gears or toothed belts. Additionally, the high-pressure pump 18 may be hydraulically actuated using fluid flow of engine oil or fuel.

There are generally two operation states for the high-pressure fuel pump 18. First, a suction stroke causes low-pressure fuel to be drawn into the pumping chamber 36 from the supply pump 16. A fuel pump control solenoid 46, which is a closeable inlet valve, is used to control fuel entering into the pumping chamber 36 based on the desired pressure increase, or target pressure set point. In one example, the solenoid valve 46 is configured to be normally open when de-energized. However it is contemplated that the reverse configuration of a solenoid valve may be used where the solenoid valve is normally closed when de-energized. In either case, the solenoid valve 46 is caused to remain open during the suction stroke to allow fuel to flow into the pumping chamber 36. Conversely, fuel may flow back toward the low-pressure pump 16 and the sump 12 when the solenoid valve 46 is open and the plunger 38 rises.

As the camshaft 34 rotates, the plunger 38 is actuated to compress the fuel within the pumping chamber 36 to increase fuel pressure. Specifically, as the camshaft lobe 42 rotates to cause the plunger 38 to rise to a maximum position, the plunger 38 reduces the volume within the pumping chamber 36, compressing fuel present inside the pumping chamber 36. The plunger 38 is sealed to an opening 47 through a portion of the pumping chamber 36 by one or more seals 48. In one example, the seal 48 is arranged as a sleeve surrounding the plunger 38. In alternative examples, the seal 48 may be configured as an O-ring seal.

In order to facilitate the pressure rise, the solenoid valve 46 is energized (or conversely de-energized) to close off fuel flow between the low-pressure fuel pump 16 and the pumping chamber 36. When the solenoid valve 46 is closed, pressure rises as the plunger 38 moves upward (in the orientation of FIG. 1). Once pressure within the pumping chamber 36 builds to a sufficient level that exceeds a pressure threshold, the fuel flow overcomes a check valve 50, allowing the pressurized fuel to exit the pump 18 and be delivered to the fuel rail 20.

The pressure rise generated within the pumping chamber 36 may be generally described by equation (1) below:

$$\frac{dP}{dt} = \frac{B \cdot (Q_{in} - Q_{out} - Q_{leak})}{V(t)} \quad (1)$$

where dP/dt represents the pressure rise or change; V(t) is the volume of the pumping chamber 36 as a function of time; B is the bulk modulus of the fuel within the pump 18; $Q_{in}$ is the flow rate into the pump through inlet fuel line 52; $Q_{out}$ is the outlet flow rate through the check valve 50 and outlet fuel line 54; and $Q_{leak}$ is the loss flow rate due to fuel pump leakage, for example from a degraded seal (e.g., seal 48).

The timing of the closing of the inlet solenoid valve 46 has a significant effect upon the amount of pressure rise developed within the pumping chamber 36. That is, there is a relationship between pump pressure, position of camshaft 34, and the state of the inlet solenoid valve 46. These elements influence opening time of the injectors 24 and can be calibrated to provide optimal performance and component life. Controller 32 is programmed to issue control signals to periodically close the inlet solenoid valve 46 at the exact time required to build desired pressure corresponding to demand of the engine 14. By precisely controlling the inlet solenoid valve 46 timing, the controller 32 may influence both of the volume and fuel outlet pressure for each pulse. When direct injection is operating properly, the high-pressure fuel pump 18 rapidly and precisely pulses fuel to the injector 24 to create the most optimal fuel-to-air mixture.

A relief valve 56 may be provided as an internal return line to compensate for excessive pressure created by the high-pressure fuel pump 18. The relief valve 56 is in fluid communication with the outlet fuel line 54 downstream of the check valve 50. In response to pressure in the outlet fuel line 54 exceeding a pressure limit threshold, the relief valve 56 opens and returns fuel to the inlet fuel line 52.

The response time of the actuation of the solenoid valve 46 may be degraded by a number of factors. Solenoid wear may cause increased mechanical resistance opposing the actuation of the solenoid valve 46. The controller 32 may be programmed to automatically adjust control signal gain to change the actuation timing of the solenoid valve 46. In one example, the control signal gain is increased to alter the timing of the solenoid valve 46 to open it sooner to capture a desired amount of fuel within the pumping chamber 36. However, there may be a limit to the timing adjustment that may be applied to the solenoid valve 46 to compensate for wear. At some point, continually opening the solenoid valve 46 sooner no longer improves response time for overcoming wear issues.

A second cause of degraded response time of the solenoid valve 46 may be leakage of the high-pressure fuel pump 18. As discussed above, loss in fuel pressure may be caused by degradation in the seal(s) 48 between the plunger 38 and the pumping chamber 36. As fuel leaks past the plunger 38 and escapes the high-pressure pump 18, a pressure drop is caused in the pumping chamber 36. Due to the leakage, the solenoid valve 46 may need to be held open longer to allow more fuel to accumulate within the chamber 36. Referring back to equation (1) above, $Q_{in}$ may be increased in order to compensate and maintain the same pressure rise in the pumping chamber 36 in spite of a fuel pump leak. The controller 32 may be programmed to automatically adjust the control signal gain to modify the open time of the solenoid valve 46 to compensate for leakage. In this case the control signal gain may be adjusted in order to increase the solenoid valve open time duration during a cycle.

The controller 32 may be programmed to receive a pressure signal from a sensor 58 that is indicative of fuel pressure downstream of the fuel pump 18. In one example, the sensor 58 is arranged to read pressure of the fuel outlet flow through the outlet fuel line 54. In other examples, the pressure of the flow through the fuel rail 20 may be sensed to provide the controller 32 with information about performance of the fuel pump 18. The controller 32 may be further programmed to adjust a control signal gain value based on the pressure signal from the sensor 58. The controller 32 may adjust the control signal gain value in response to deviation in the outlet fuel pressure relative to the fuel pressure set point.

In one example, if fuel pump output fuel pressure deviates from the pressure set point by a shutdown threshold value, the controller 32 may recognize a severe fault and cause a deactivation of the high-pressure fuel pump 18. In this case, the powertrain may operate in a low-pressure "limp" mode where the inlet solenoid valve 46 is caused to remain open such that fuel is provided to the fuel rail 20 under pressures as delivered by the low-pressure supply pump 16. As discussed above, the solenoid valve 46 may be configured to remain open while de-energized or alternatively require energy to remain in the open state. In the limp mode, the powertrain remains operable, but performance of the engine 14 is reduced.

If a deviation in the pressure rise created by the high-pressure pump 18 deviates from the pressure set point by less than the shutdown threshold, the controller 32 may operate the pump 18 utilizing modified control gains to adjust the solenoid valve 46 timing to maintain the fuel outlet pressure as close to the pressure set point as possible. However, such deviations may be an indication of degrading performance of the high-pressure fuel pump 18 and a precursor to ultimate pump failure.

Figure 2:
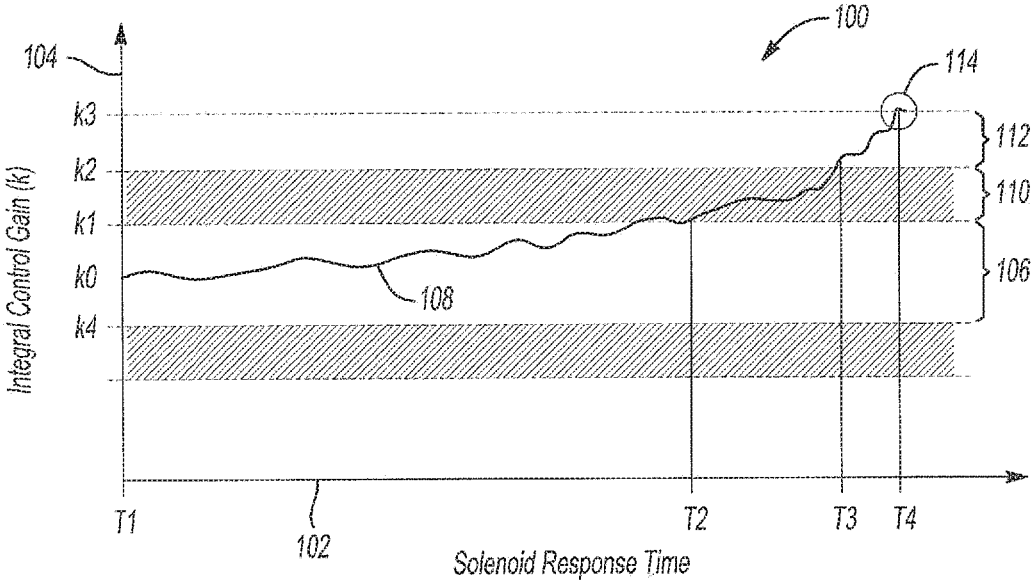
FIG. 2 is a plot of control signal gain versus solenoid valve response time of a solenoid that may be used in the fuel delivery system of FIG. 1, according to the principles of the present disclosure.

Referring now to FIG. 2, plot 100 depicts degraded performance of a high-pressure fuel pump 18. Horizontal axis 102 represents response time of the solenoid valve 46. The vertical axis 104 represents control gains as applied by the controller 32 based on compensating for degradation in response time of the solenoid valve 46. Curve 108 represents adjustments in the gain value k with respect degradations in solenoid response time. A new solenoid valve 46 may have a baseline response time T1 at optimal component performance. For a healthy pump 18, the timing of the solenoid opening and closing to deliver necessary fuel is determined by an initial calibration. In this case, a nominal gain k0 corresponding to a calibrated gain value is applied to the control signal. The calibrated gain value may be set based on fuel demand corresponding to normalized engine operating conditions when the fuel pump 18 is new.

As discussed above, the controller 32 is programmed to adjust the gain value of the control signal if the output pressure of the high-pressure fuel pump 18 deviates from the pressure set point. The adjustment compensates for changes in pump performance over time in order to deliver necessary fuel output to match the pressure set point. In the example of FIG. 2, the gain value k is increased to compensate for increased solenoid response time. In other variations, the gain may be decreased to achieve a desired effect on fuel delivery system operation.

In the illustrated example, when the applied control system gain is within a nominal region, such as gain region 106, the fuel delivery system 10 is functioning properly. If the control signal is adjusted by the controller 32 to a value greater than a gain value k1, which is outside of a threshold gain region 106, this could be indicative of an issue with the pump 18 and/or the solenoid valve 46. The gain value k1 corresponds to a degraded solenoid response time T2. A region 110 (between k1 and k2) may indicate a need to service one or more components of the fuel delivery system 10 soon. If repair service is not performed and the solenoid response time continues to increase, a failure may be imminent, such as when the control gain signal exceeds k2 at response time T3. The gain value within the range indicated by gain region 112 (between k2 and k3) represents an operating band in which failure is imminent. In the continued absence of service, the gain value k may continue to be adjusted corresponding to a degraded solenoid response time. However there is an upper limit to which the gain value may be adjusted and maintain solenoid valve operation. For example, a critical gain value k3 is the failure threshold where the solenoid valve 46 becomes inoperable. At operating conditions at about location 114, the fuel pump 18 may fail due to requiring gain values outside of the authority of the controller 32. In one example, the controller 32 may deactivate the high-pressure fuel pump 18 and enter limp home mode as discussed above, delivering fuel by the low-pressure supply fuel pump 16 only. A series of warning messages may be sent to a vehicle operator, system, or technician when each of the gain thresholds k1, k2, k3 are crossed.

Although the plot 100 of FIG. 2 depicts the gain value increasing to compensate for solenoid performance, it should be appreciated that certain operating conditions may cause the gain value to be reduced below the calibrated gain value k0. Similar to previous examples, a warning message may be issued while the control signal gain is below k4 or with other lower thresholds.

Figure 3:
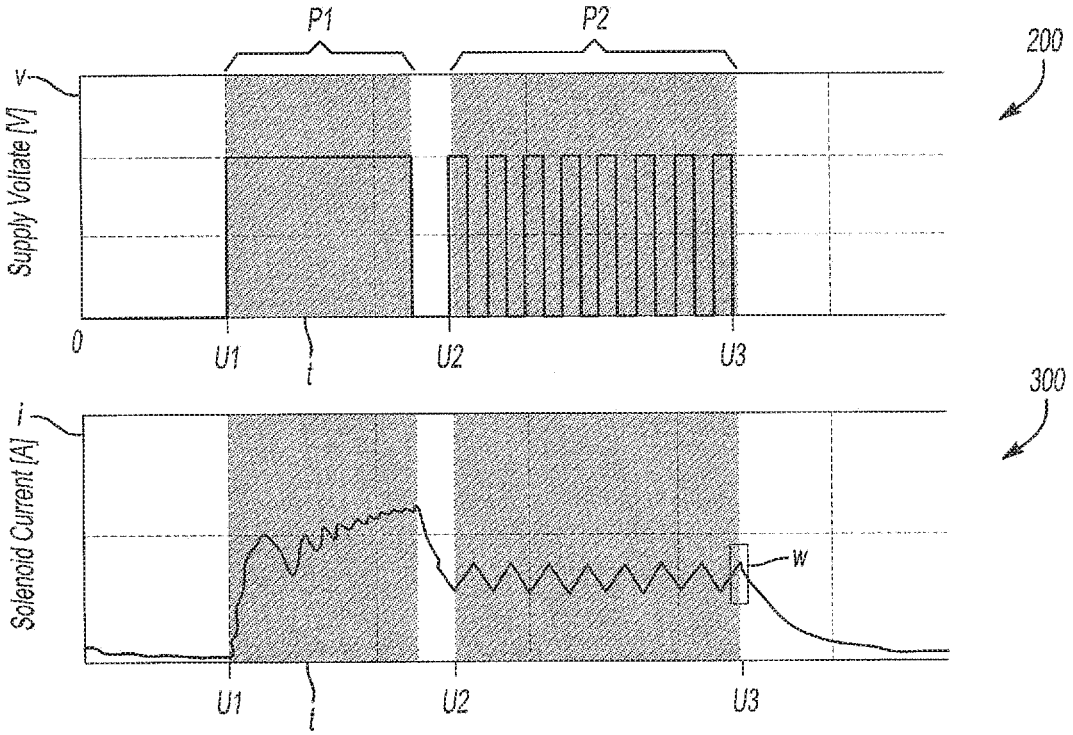
FIG. 3 includes a plot of voltage applied to the solenoid and current feedback of the solenoid that may be used in the fuel delivery system of FIG. 1, both as a function of time, in accordance with the principles of the present disclosure.

The solenoid valve 46 is energized by a control signal from the controller 32, which may be in the form of a pulse width modulation (PWM) signal. A typical voltage profile to energize the solenoid valve 46 is illustrated in FIG. 3 at 200, where voltage V is illustrated on a vertical axis and time t is illustrated on a horizontal axis. At time U1, the solenoid valve 46 is energized in a pull-in phase P1 corresponding to 100% duty cycle of the PWM voltage signal. The pull-in phase P1 is intended to move the armature (not shown) of the solenoid valve 46 from rest and close the solenoid valve 46 as fast as possible. Once the solenoid valve 46 is closed, the duty cycle is reduced in a hold phase P2 for as long as the solenoid valve 46 is closed, where the hold phase P2 starts at or around time U2. The solenoid valve 46 is deenergized and opened at time U3, where the voltage drops to zero and remains at zero until the solenoid valve 46 is energized again to close the solenoid valve 46.

As will be described in further detail below, a solenoid current feedback may be measured or detected and used to diagnose the solenoid valve 46. For example, the solenoid current feedback may be used to conduct a prognosis of certain failure modes of the solenoid valve 46. The controller 32 may be further programmed to provide an owner and/or service technician with any of a number of messages about the suspected failure mode of the solenoid valve 46.

Referring back to FIG. 3, a current of the solenoid valve 46 is illustrated as a function of time at section 300 of the plot. Current i is illustrated along the vertical axis and time t is illustrated along the horizontal axis, which is lined up with the time t shown in the applied voltage graph 200. Prior to time U1, no voltage or current is applied to the solenoid valve 46. At time U1, during the pull-in phase P1, current i may appear as shown between times U1 and U2 in graph 300, as the voltage is applied with the 100% duty cycle to quickly close the solenoid valve 46. In the hold phase P2, or hold timeframe, which starts around time U2 and continues to time U3, the current i takes on an oscillating profile, as shown. At or around time U3 (when the solenoid valve 46 is deenergized), a solenoid current feedback may be collected in window w to analyze the proper functioning of the solenoid valve 46. The solenoid current feedback may be collected any time during the hold timeframe P2 or at the start of the solenoid off timeframe that begins at time U3. In other words, the ECM or other controller 32 may read the value of the solenoid current feedback i at window w, which in this example, is when then valve 46 transitions from on to off. Thus, in some examples, the solenoid current feedback may be defined as the amount of current i flowing through the solenoid valve 46 in the sampling window w, which could be at the beginning of the solenoid off timeframe.

Figure 4:
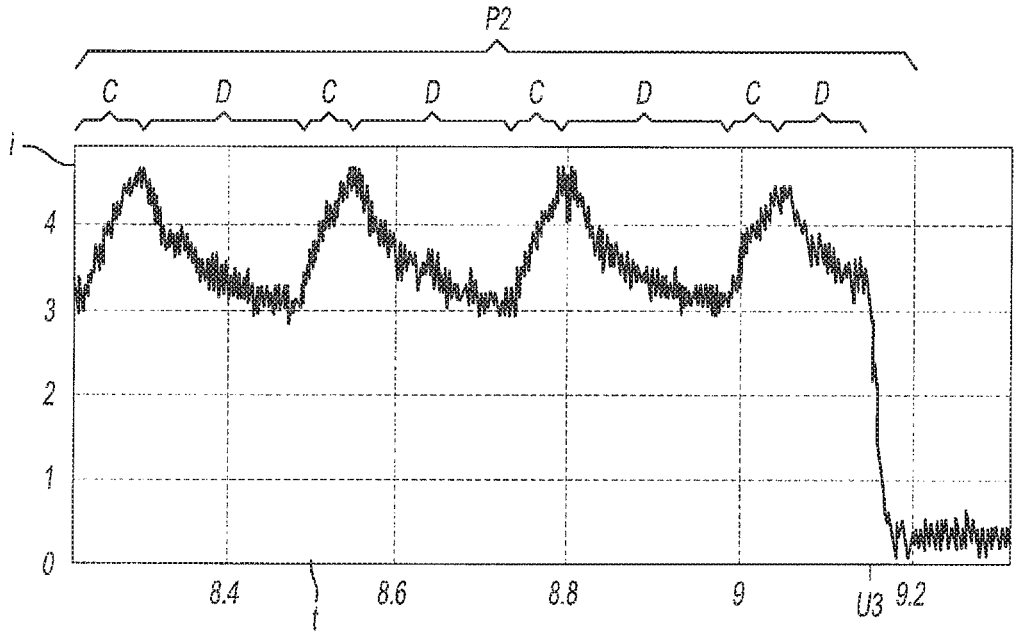
FIG. 4 is a plot of current feedback of the solenoid that may be used in the fuel delivery system of FIG. 1, as a function of time, during and shortly after an energized hold timeframe, according to the principles of the present disclosure.

Referring now to FIG. 4, with continued reference to FIG. 3, during the hold phase P2, PWM voltage with a constant duty cycle is sent to the solenoid valve 46 to keep the plunger 38 in a fixed location by charging and discharging the electromagnetic coil 62 (shown in FIG. 6) of the solenoid valve 46 repeatedly. In FIG. 4, solenoid current i is illustrated on the vertical axis and time t is illustrated on the horizontal axis, where current i is in amperes (A) and time t is shown in milliseconds (ms). Since there is no movement of the plunger 38, the inductance generated by the electromagnetic coil 62 stays constant. Thus, during the hold phase P2, the electromagnetic coil 62 is constantly charging (in regions C) and discharging (in regions D) with sufficient mean current i to keep the plunger 38 at the fixed location. During charging (in the C regions), the solenoid current i will increase from the initial value until the power supply is turned off in regions D. After that, the power supply is turned off (as the PWM voltage V is cycled off) and the electromagnetic coil 62 starts to discharge, resulting in a decrease in the current profile in region D. The duty cycle at the hold phase P2 may be set so that the energy the electromagnetic coil 62 absorbs during charging is equal to the energy it dissipates during discharging, as shown in FIG. 4. The solenoid valve 46 is then deenergized at time U3 and the current i drops off.

Figure 5:
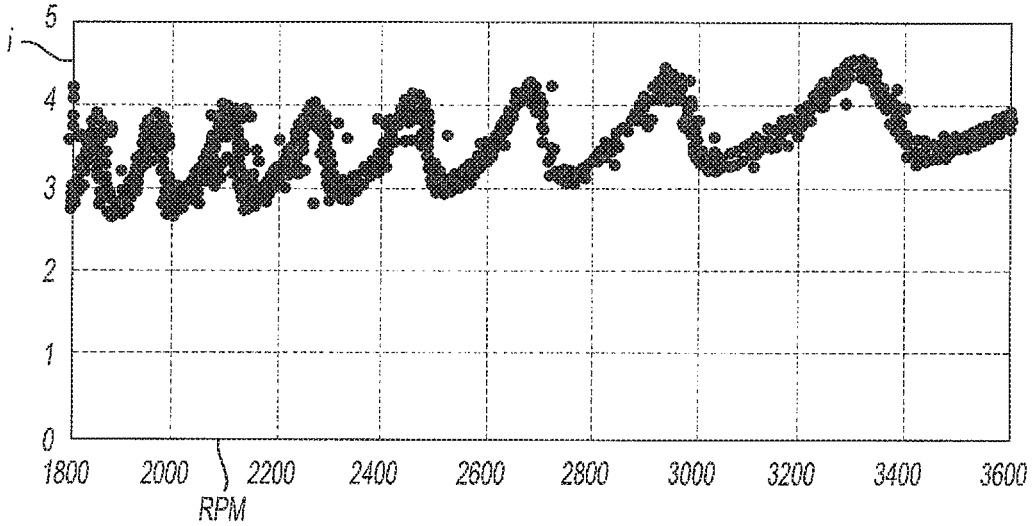
FIG. 5 is a plot of current feedback of the solenoid that may be used in the fuel delivery system of FIG. 1, as a function of engine speed, in accordance with the principles of the present disclosure.

With reference to FIG. 5, solenoid current i is illustrated in amperes (A) on the vertical axis and engine speed RPM is illustrated on the horizontal axis. As the engine speed increases, the current i takes on a sawtooth-shaped profile with increasing magnitude and period. Analyzing the current feedback as a function of engine RPM can reduce the operational variations.

Bad Electrical Connection

Figure 6:
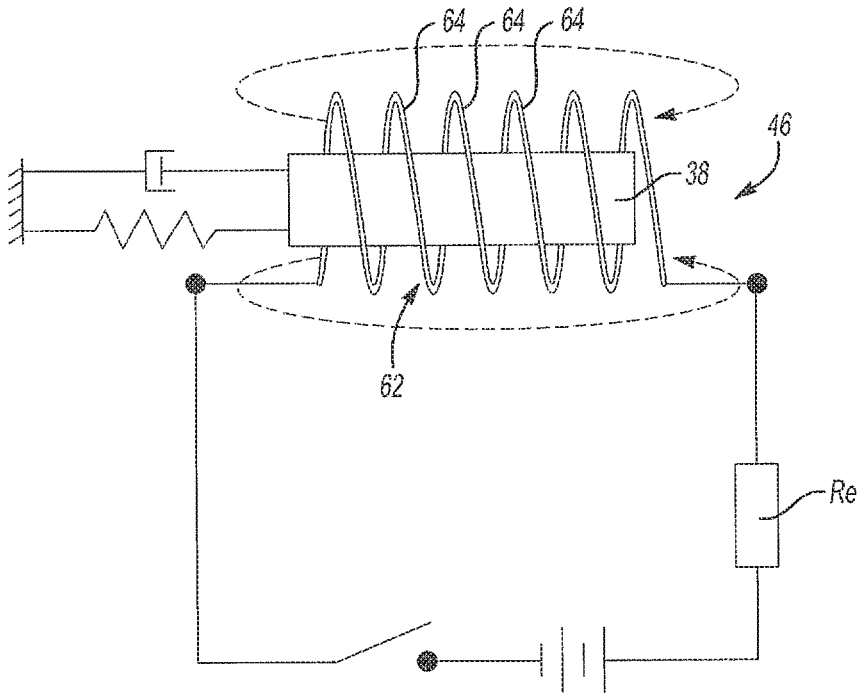
FIG. 6 is a schematic of a solenoid that may be used in the fuel delivery system of FIG. 1, according to the principles of the present disclosure.

Corrosion of the solenoid valve 46 connectors, or a generally loose connection, can cause electrical resistance to increase in the electrical pathway to the solenoid valve 46 in the pump circuit. Such a phenomenon is referred to herein as a bad electrical connection. Referring to FIG. 6, a schematic of the solenoid valve 46 having a bad electrical connection is illustrated. Since the pump voltage is fixed, adding more resistance Re to the circuit results in less current reaching the solenoid valve 46, which is true across all engine speeds. The magnetic force generated by the solenoid 46 is directly proportional to the square of the current through the solenoid 46. The decrease in current, therefore, decreases the magnetic force. A smaller magnetic force causes the solenoid valve 46 to take more time to close, and therefore, to close more slowly. As a result, the pump 18 traps less fuel compared to its nominal condition, less fuel is delivered to the fuel rail 20 than desired, and the rail pressure decreases. The controller 32 compensates by issuing a solenoid closing command earlier so that the same amount of fuel as for a nominal pump can be trapped in the pumping chamber 36 and delivered into the fuel rail 20. In other words, the gain k may be increased by the controller 32, as shown and described with respect to FIG. 2.

Figure 7:
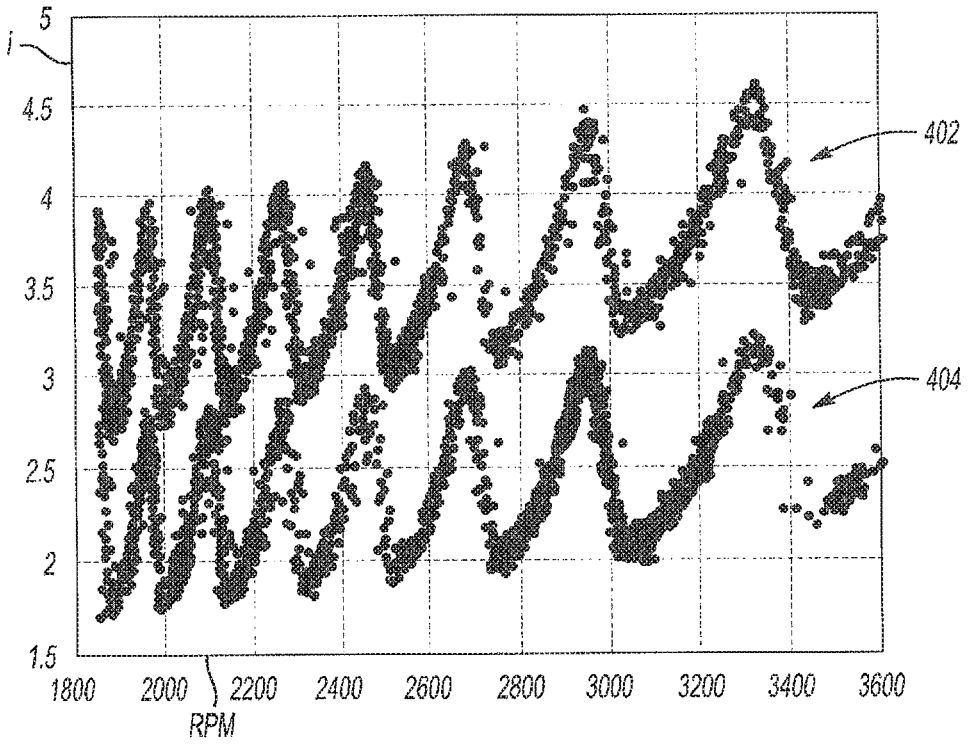
FIG. 7 is a plot of solenoid current feedback of a normally functioning solenoid and of a solenoid having a bad electrical connection or increased electrical resistance, both as a function of engine speed, which may be used in the fuel delivery system of FIG. 1, in accordance with the principles of the present disclosure.

Referring now to FIG. 7, a plot of current i for a normally functioning solenoid is compared to current i for a solenoid having a bad electrical connection (e.g., increased resistance in the circuit). Current i is illustrated on the vertical axis, and engine speed RPM is illustrated on a horizontal axis. The current i for a normally functioning solenoid is illustrated at sawtooth plot 402 across multiple engine speeds, and the current i for a solenoid with a bad electrical connection is illustrated at sawtooth plot 404 across multiple engine speeds. In this example, the solenoid with the bad electrical connection shown in plot 404 has an increased resistance of about 0.4 Ohm at 20 degrees C., and the total electrical resistance of the circuit in this example is about 0.8 Ohm at 20 degrees C. It should be understood that the example in FIG. 7 is illustrative only, and other resistances in the total circuit and/or the bad electrical connection could exist in other examples, without falling beyond the spirit and scope of the present disclosure.

As can be seen in FIG. 7, both plots 402 and 404 generally share the same sawtooth shape, but the plot 404 of the circuit having extra electrical resistance has much lower values of current i. Accordingly, it can be concluded that a bad electrical connection, or increased resistance in the solenoid circuit, causes a decreased current i in the current feedback of the solenoid 46, as compared to a normally functioning solenoid valve 46.

Figure 8:
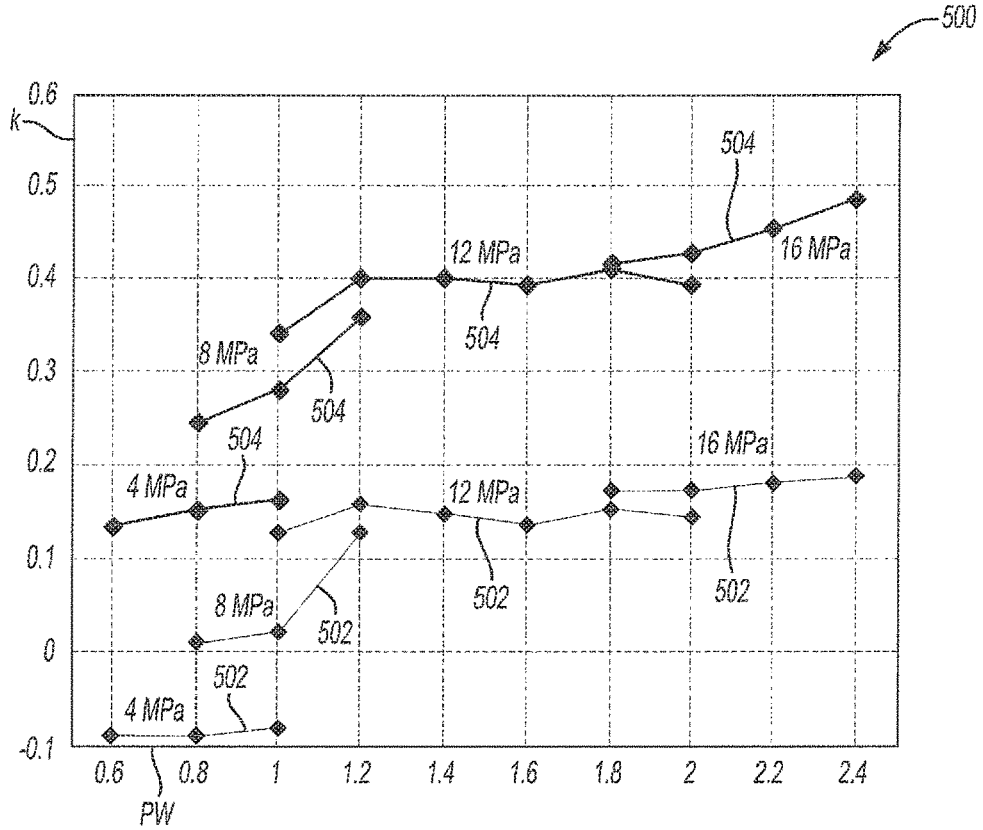
FIG. 8 is a plot of control signal adjustments for a normally functioning solenoid and of a solenoid having a bad electrical connection or increased electrical resistance, both as a function of pulse width of the applied voltage in milliseconds, which may be used in the fuel delivery system of FIG. 1, in accordance with the principles of the present disclosure.

Referring now to FIG. 8, a plot 500 illustrates the effect of a bad electrical connection on the control adjustment k. In plot 500, control adjustment k is illustrated on a vertical axis and the injector pulse width signal PW is illustrated on a horizontal axis. The control adjustment k for a normally functioning solenoid is illustrated at lines 502 across multiple injector pulse widths, and the control adjustment k for a solenoid with a bad electrical connection is illustrated at lines 504 across multiple pulse widths. As can be seen in FIG. 8, both sets of lines 502, 504 generally share the same shape, but the plot 504 of the control adjustment k for the solenoid having extra electrical resistance (e.g., a bad electrical connection) has much higher values of control adjustment k. Accordingly, it can be concluded that a bad electrical connection, or increased resistance in the solenoid circuit, causes a greater control adjustment k, as compared to a normally functioning solenoid valve 46.

Weakened Electromagnetic Field

Electric current through the electromagnetic coil 62 of the solenoid valve 46 results in joule heating of the coil 62. Joule heating causes expansion of the electromagnetic coil 62 and induces relative motion from layer to layer (in the radial direction) and turn to turn (in the axial direction). The sheer stress on the insulator film of the electromagnetic coil 62, due to relative motion from thermal expansion and contraction, can gradually wear down the insulation film and eventually result in short circuiting of the electromagnetic windings 64 (shown in FIG. 6). Short circuiting of the coil windings 64 leads to an electromagnet that has a weakened field, as both the number of effective turns is reduced (because adjacent windings 64 become essentially a single winding 64 for electrical conduction) and the length in the coil 62 is reduced, and the coil resistance and inductance is likewise reduced. In some cases, short circuiting of the coil windings 64 could also lead to a shorted inductance loop.

Figure 9:
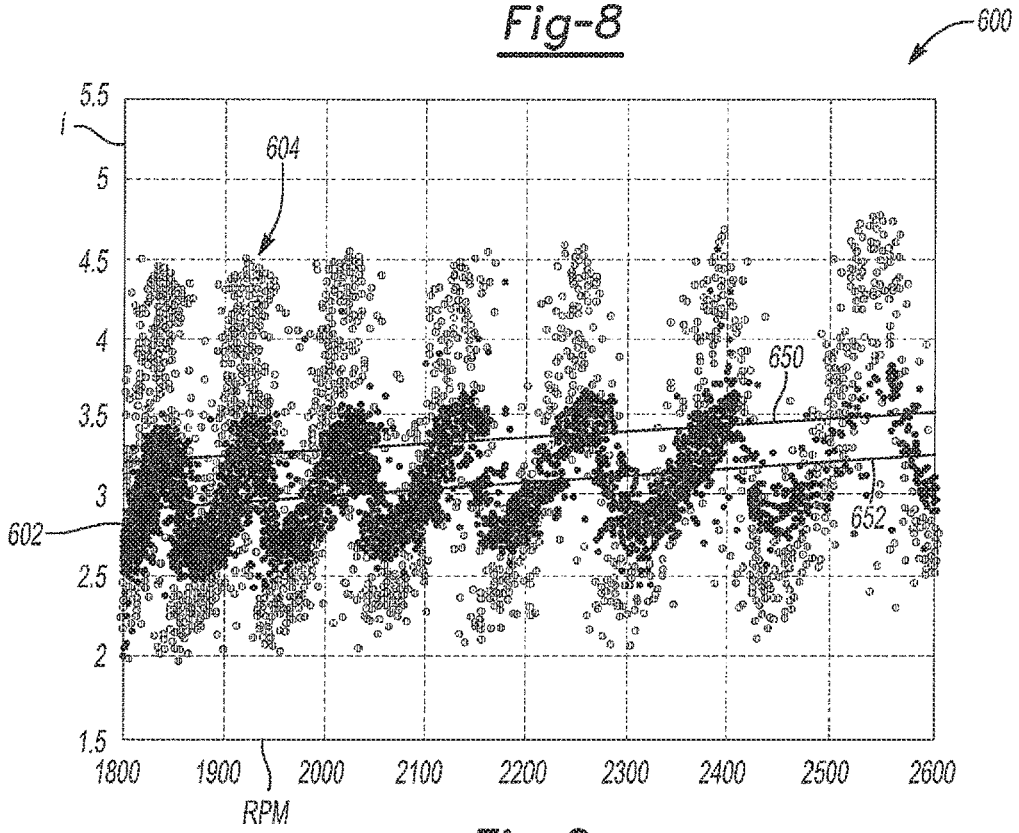
FIG. 9 is a plot of solenoid current feedback of a normally functioning solenoid and of a solenoid having a weakened electromagnetic field, both as a function of engine speed, which may be used in the fuel delivery system of FIG. 1, in accordance with the principles of the present disclosure.

When the electromagnetic field is weakened, the charging and discharging occurs at a faster rate. Within a fixed charging and discharging time window, faster response results in larger peak-to-peak variation in the current feedback signal. Referring to FIG. 9, a plot of current i of a normally functioning solenoid is compared to current i of a solenoid having a weakened electromagnetic field. Current i is illustrated on the vertical axis, and engine speed RPM is illustrated on a horizontal axis. The current i of a normally functioning solenoid is illustrated at sawtooth plot 602 across multiple engine speeds, and the current i of a solenoid with a weakened electromagnetic field is illustrated at sawtooth plot 604 across multiple engine speeds. In this example, the solenoid with the weakened electromagnetic coil 62 shown in plot 604 has a much larger peak-to-peak current i across all engine speeds, and in at least some cases, the peak-to-peak variation is double or more of the normal solenoid peak-to-peak variation that is shown in plot 602. It should be understood that the example in FIG. 9 is illustrative only, and other magnitudes of current i could exist in other examples, without falling beyond the spirit and scope of the present disclosure.

As can be seen in FIG. 9, both plots 602 and 604 generally share the same sawtooth shape, but the plot 604 of the circuit having a weakened electromagnetic field has a much larger peak-to-peak variation of current i. Accordingly, it can be concluded that a solenoid valve 46 having a weakened electromagnetic field causes a current feedback i having a larger peak-to-peak variation, as compared to a normally functioning solenoid valve 46.

In addition, a mean current 650 of the plot 604 of the circuit having the weakened electromagnetic field is greater than a mean current 652 of the plot 602 of the normally functioning solenoid. Therefore, if the mean current has increased beyond a nominal threshold, a solenoid fault can be identified as a short circuiting of the electromagnetic coil windings 64, which may also be referred to as a weakened electromagnetic field fault herein.

In some cases, when the electromagnetic coil windings 64 are shorted, a short circuit inductance loop may occur. In that case, the current feedback may not have a significant amount of peak-to-peak variation, but the mean 650 will still be above a predetermined threshold. Accordingly, if the solenoid current does not have a large peak-to-peak variation in current, but it does have a mean 650 exceeding a predetermined high current threshold, a solenoid fault could be identified as a shorted coil fault or a weakened electromagnetic field fault.

Figure 10:
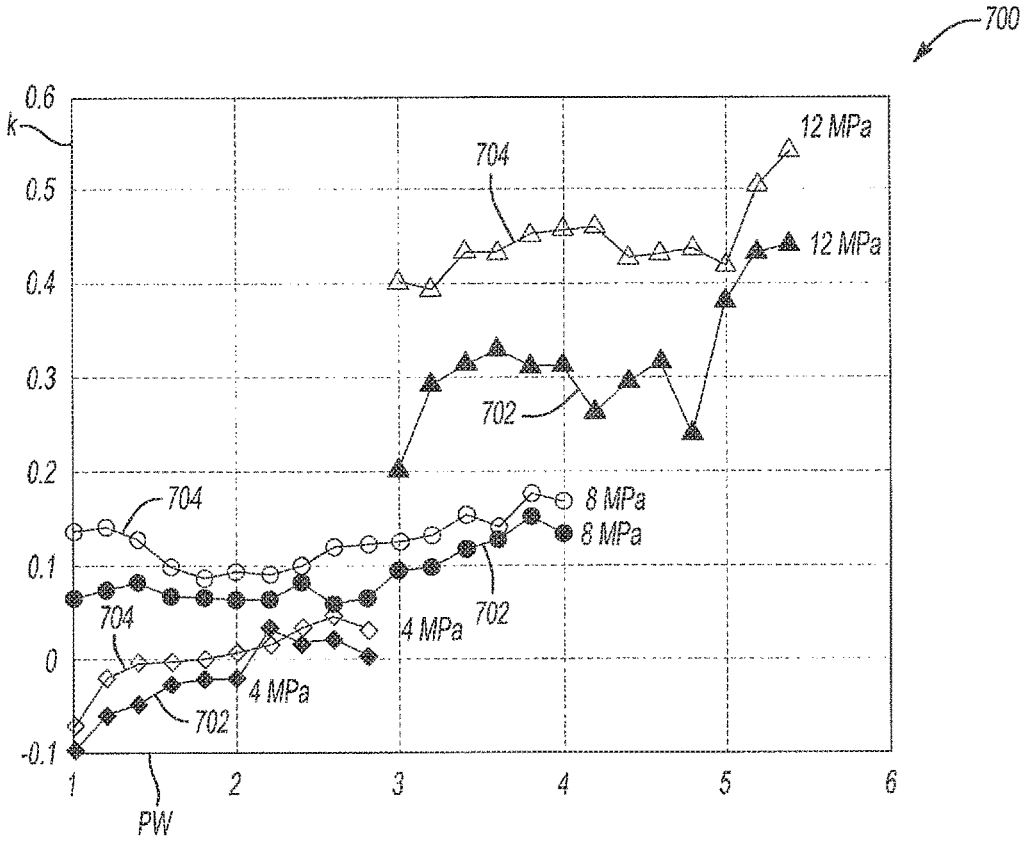
FIG. 10 is a plot of control signal adjustments for a normally functioning solenoid and of a solenoid having a weakened electromagnetic field, both as a function of injector pulse width in milliseconds, which may be used in the fuel delivery system of FIG. 1, in accordance with the principles of the present disclosure.

Referring now to FIG. 10, a plot 700 illustrates the effect of a weakened electromagnetic field on the control adjustment k. In plot 700, control adjustment k is illustrated on a vertical axis and injector pulse width signal PW (in ms) is illustrated on a horizontal axis. The control adjustment k for a normally functioning solenoid is illustrated at lines 702 across multiple pulse widths, and the control adjustment k for a solenoid with a weakened electromagnetic field is illustrated at lines 704 across multiple pulse widths. In this example, the solenoid having the weakened electromagnetic field has ¾ the length of the normally functioning solenoid, as an illustrative example. As can be seen in FIG. 10, both sets of lines 702, 704 generally share the same shape, but the lines 704 of the control adjustment k for the solenoid having a shorter length (e.g., a weakened electromagnetic field) has much higher values of control adjustment k at greater pulse widths (which correspond to higher engine speeds and higher pressures). Accordingly, it can be concluded that a weakened electrical field, or a shorter-length solenoid, causes a greater control adjustment k at higher speeds and greater pulse widths, as compared to a normally functioning solenoid valve 46.

Figure 11:
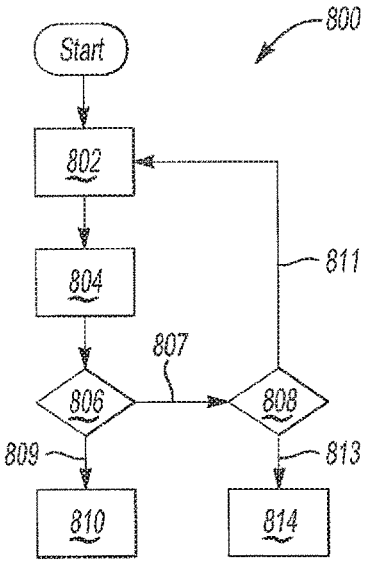
FIG. 11 is a block diagram of a method of conducting a fuel pump solenoid prognosis, according to the principles of the present disclosure.

Referring now to FIG. 11, a block diagram of a method of conducting a fuel pump solenoid prognosis is illustrated and generally designated at 800. The method 800 may be implemented by one or more controllers 32. The present disclosure also contemplates a prognosis system and fuel delivery system implementing the control steps of the method 800.

In step 802, the method 800 includes a step or control logic configured to determine a solenoid current feedback of a fuel pump control solenoid, such as the solenoid valve 46. The current feedback may be collected across various operating conditions, which may include temperature, engine speed, injector pulse width, and desired fuel pressure, by way of example. As explained above, the current feedback may be collected by measuring or detecting an amount of current flowing through the solenoid valve 46, at a range of operating conditions including engine speeds. The current feedback may then be normalized against the range of operating conditions, if desired. In some cases, the current feedback may be determined by calculating an average and a standard deviation of a difference between an actual solenoid current feedback signal and an expected solenoid current feedback signal. The current feedback may be collected at the beginning of the solenoid off timeframe, such as in window w shown in FIG. 3, or during the hold timeframe.

In step 804, the method 800 includes a step or control logic configured to determine a magnitude of variation of the solenoid current feedback. To determine the magnitude, the current feedback may be collected across various operating conditions, which may include temperature, engine speed, injector pulse width, and desired fuel pressure, by way of example. The magnitude of the current feedback may then be normalized against the range of operating conditions, if desired.

The method 800 then includes a step or control logic 806 configured to determine whether the magnitude of variation of the solenoid current feedback exceeds a predetermined variation threshold. For example, with reference to FIG. 9, a predetermined variation threshold may be set somewhere above the expected magnitude in peak-to-peak variation of a normally operating solenoid as shown at plot 602. The step 806 may be configured to determine whether the actual current feedback magnitude is deviating from the expected current feedback by determining whether the actual current feedback magnitude is greater than the predetermined variation threshold. If the standard deviation of the current feedback has been calculated as part of the current feedback determination, and the standard deviation is larger than a predetermined threshold, it can be determined that the current feedback of the solenoid valve 46 is exceeding the predetermined variation threshold. If in step 806, it is determined (in any manner) that the magnitude, or variation in peak-to-peak current, does not exceed the predetermined variation threshold, the method 800 may follow path 807 to step 808. If, however, the magnitude does exceed the predetermined variation threshold, the method 800 proceeds along path 809 to step 810.

Furthermore, in step 806, a determination may be made as to whether a solenoid current feedback mean or average has increased above a predetermined high current threshold. For example, with reference to FIG. 9, a predetermined high current threshold may be set somewhere above the mean current feedback 652 of a normally operating solenoid, but below an expected mean of a solenoid having a shorted coil, such as mean 650. The step 806 may be configured to determine whether the solenoid current feedback mean is deviating from the expected current feedback by having increased beyond the predetermined high current threshold. If the mean exceeds the predetermined high current threshold, the method 800 also proceeds along path 809 to step 810.

In step 808, the method 800 and/or prognosis system are configured to determine whether the solenoid current feedback is less than a predetermined low current threshold. For example, with reference to FIG. 7, a predetermined current threshold may be set somewhere below the expected current feedback of a normally operating solenoid as shown at plot 402. The step 804 may be configured to determine whether the actual current feedback is deviating from the expected current feedback by determining whether the actual current feedback is less than the predetermined current threshold. If the average current feedback has been calculated as part of the current feedback determination, the average current feedback can be compared against a threshold under which the average can be said to be different than, and below, normal. If in step 808, it is determined that the current feedback is not less than the predetermined current threshold, the method 800 may proceed along path 811 back to step 802 or onto any other additional desired steps. If, however, the current feedback is indeed less than the predetermined current threshold, the method 800 proceeds along path 813 to step 814.

In step 810, the method 800 and/or prognosis system are configured to indicate a potential solenoid weakened electromagnetic field fault (if the solenoid current feedback is greater than the predetermined variation threshold and/or the mean exceeds the predetermined high current threshold, as indicated along path 809). In step 814, the method 800 and/or prognosis system are configured to indicate a potential solenoid electrical connection fault if the solenoid current feedback is less than the predetermined current threshold and less than the predetermined variation threshold (as indicated along paths 807 and 813).

Figure 12:
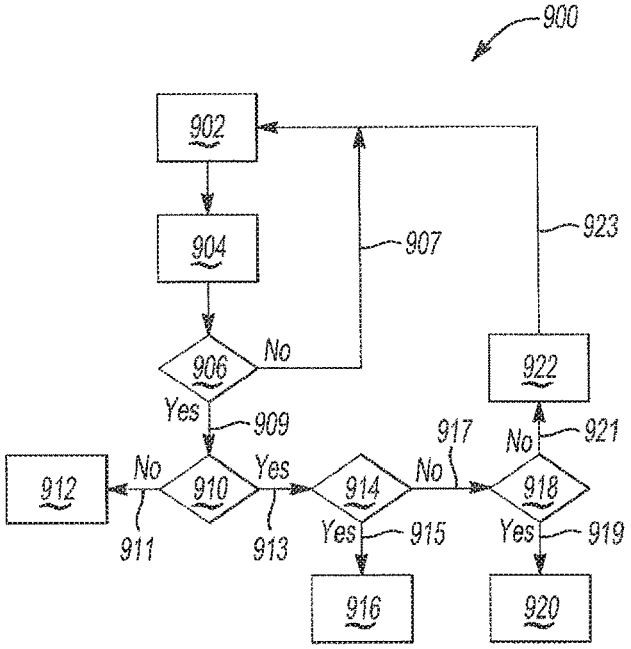
FIG. 12 is a block diagram of another variation of a method of conducting a fuel pump solenoid prognosis, in accordance with the principles of the present disclosure.

Referring now to FIG. 12, a block diagram of another variation of a method of conducting a fuel pump solenoid prognosis is illustrated and generally designated at 900. The method 900 may be implemented by one or more controllers 32. The present disclosure also contemplates a prognosis system and fuel delivery system implementing the control steps of the method 900.

In step 902, the method 900 includes a step or control logic configured to determine a solenoid current feedback of a fuel pump control solenoid, such as the solenoid valve 46. The current feedback may be collected across various operating conditions, which may include temperature, engine speed, injector pulse width, and desired fuel pressure, by way of example. As explained above, the current feedback may be collected by measuring or detecting an amount of current flowing through the solenoid valve 46, at a range of operating conditions including engine speeds. In some cases, the current feedback may be determined by calculating an average and a standard deviation of a difference between an actual solenoid current feedback signal and an expected solenoid current feedback signal. The current feedback may be collected at the beginning of the solenoid off timeframe, such as in w shown in FIG. 3, or during the hold timeframe.

In a step 904, the collected current feedback may then be normalized against the range of operating conditions, if desired.

In step 906, the method 900 is configured to determine whether the current feedback is deviating from nominal or normal. To determine deviation, the current feedback may be compared against the predetermined current threshold and the predetermined variation threshold, by way of example. If the current feedback is not deviating from normal, the method 900 is configured to proceed along path 907 back to step 902 to monitor current feedback. If, however, the current feedback is deviating from normal, the method 900 proceeds along path 909 to step 910.

In step 910, the method 900 and/or control/prognosis system is configured to determine whether the control adjustment is deviating from nominal or normal. The control adjustment may be considered to deviate from normal or nominal if the adjustment k is greater than expected, such as shown in FIGS. 8 and 10 and in FIG. 2. For example, this step 910 may be performed by determining a plurality of control signal adjustment gain values k applied to a control signal for controlling the solenoid valve 46, normalizing the plurality of control signal adjustment gain values k against a range of operating conditions to define a set of normalized control signal adjustment gain values, and determining whether any of the normalized control signal adjustment gain values lies outside of a predetermined range. If the control adjustment k is not greater than expected or outside of the predetermined range, the method 900 may indicate a normal control signal adjustment and proceed along path 911 to step 912.

If the control adjustment k is not deviating from normal (i.e., is normal), as determined in step 910, but the current feedback is deviating from normal, as determined in step 906, the control logic arrives at step 912. In step 912, it is determined or indicated that bad current sensing is suspected, which could be a possible ECU fault.

If in step 910 it is determined that the control adjustment is deviating from normal, the method 900 proceeds from step 910 along path 913 to step 914. In step 914, the method 900 includes a step or control logic configured to determine whether the solenoid current feedback has a large variation and/or whether the mean of the feedback current has increased beyond a predetermined high current threshold.

This may be determined, for example, by first determining a magnitude of variation of the solenoid current feedback and then determining whether the magnitude of variation of the solenoid current feedback exceeds a predetermined variation threshold. For example, with reference to FIG. 9, a predetermined variation threshold may be set somewhere above the expected magnitude in peak-to-peak variation of a normally operating solenoid as shown at plot 602. The step 910 may be configured to determine whether the actual current feedback magnitude is deviating from the expected current feedback magnitude by determining whether the actual current feedback magnitude is greater than the predetermined variation threshold. In addition, or in the alternative, if the standard deviation of the current feedback has been calculated as part of the current feedback determination, and the standard deviation is larger than a predetermined threshold, it can be determined that the current feedback of the solenoid valve 46 is exceeding the predetermined variation threshold.

Furthermore, in step 914, the method 900 and/or control/prognosis system may be configured to determine whether a solenoid current feedback mean or average has increased above a predetermined high current threshold. For example, with reference to FIG. 9, a predetermined high current threshold may be set somewhere above the mean current feedback 652 of a normally operating solenoid, but below an expected mean of a solenoid having a shorted coil, such as mean 650. The step 914 may be configured to determine whether the solenoid current feedback mean is deviating from the expected current feedback by having increased beyond the predetermined high current threshold.

If the magnitude does exceed the predetermined variation threshold or the mean of the current feedback is indeed greater than the predetermined high current threshold, the method 900 proceeds along path 915 to step 916.

Although the step 914 may make a determination about whether the current exceeds the predetermined variation threshold and whether the mean current exceeds the predetermined high current threshold, it should be understood that in some variations, only one or the other may be compared against, or these comparisons may be broken out into separate steps.

In step 916, the method 900 and/or control/prognosis system are configured to indicate a potential solenoid weakened electromagnetic field fault. This could mean that the solenoid coil 62 is short circuiting.

If, however, in step 914, it is determined that the magnitude, or variation in peak-to-peak current, does not exceed the predetermined variation threshold and/or does not have a large variation and/or has not increased, the method 900 may proceed from step 914 along path 917 to step 918.

In step 918, the method 900 and/or control/prognosis system are configured to determine whether the solenoid current feedback has decreased below a predetermined low current threshold. For example, with reference to FIG. 7, a predetermined low current threshold may be set somewhere below the expected current feedback of a normally operating solenoid as shown at plot 402. The step 918 may be configured to determine whether the actual current feedback is deviating from the expected current feedback by having decreased to less than the predetermined low current threshold. If the mean or average current feedback has been calculated as part of the current feedback determination, the mean or average current feedback can be compared against a threshold under which the average can be said to be different than, and below, normal. If in step 918, it is determined that the current feedback is indeed less than the predetermined low current threshold, the method 900 proceeds along path 919 to step 920.

In step 920, the method 900 and/or control/prognosis system are configured to indicate a potential solenoid electrical connection fault if the solenoid current feedback is less than the predetermined low current threshold, as indicated along path 919. If in step 918, however, it is determined that the current feedback is not less than the predetermined low current threshold, the method 900 may proceed along path 921 to step 922.

In step 922, the method 900 or control/prognosis indicates a fault or malfunction due to an unknown failure mode, which could be an ECU malfunction. The method 900 may then proceed along path 923 back to step 902. The method 900 may also proceed back to step 902 from any of the other final steps 912, 916, 920.

Warning messages based on the particular faults may be sent to the driver, the vehicle computer/controller, and/or to any other vehicle health management system, tools, or persons (such as a service technician). Any number of varying degree severity messages may be generated based on the solenoid feedback current detected. For example, multiple levels of warnings may be provided prior to generating an imminent failure message, where each level may include a different severity indicator. Further, different severity warning messages may have a specific combination of one or more recipients such as a driver, service technician, vehicle fleet operator, or vehicle manufacturer for example. The warning messages may include what type of fault is indicated, such as a potential weakened electromagnetic field fault, a potential solenoid electrical connection fault, a bad current sensing fault, and/or an unknown failure mode. For example, the method and/or control/prognosis system may be configured to: issue a potential solenoid electrical connection fault warning message if the potential solenoid electrical connection fault is indicated, issue a potential solenoid weakened electromagnetic field fault warning message if the potential solenoid weakened electromagnetic field fault is indicated, and/or issue a potential bad current sensing fault warning message if the potential bad current sensing fault is indicated.

The processes, methods, or algorithms disclosed herein can be deliverable to, and/or implemented by a processing device, controller, or computer, which can include any existing programmable electronic control unit or dedicated electronic control unit. Similarly, the processes, methods, or algorithms can be stored as data and instructions executable by a controller or computer in many forms including, but not limited to, information permanently stored on non-writable storage media such as ROM devices and information alterably stored on writeable storage media such as floppy disks, magnetic tapes, CDs, RAM devices, and other magnetic and optical media. The processes, methods, or algorithms can also be implemented in a software executable object. Alternatively, the processes, methods, or algorithms can be embodied in whole or in part using suitable hardware components, such as Application Specific Integrated Circuits (ASICs), Field-Programmable Gate Arrays (FPGAs), state machines, controllers or other hardware components or devices, or a combination of hardware, software and firmware components. Such example devices may be onboard as part of a vehicle computing system or be located off-board and conduct remote communication with devices on one or more vehicles.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A method of conducting a fuel pump solenoid prognosis, the method comprising:

determining a solenoid current feedback of a fuel pump control solenoid;

determining whether the solenoid current feedback is less than a predetermined low current threshold;

determining a magnitude of variation of the solenoid current feedback;

determining whether the magnitude of variation of the solenoid current feedback exceeds a predetermined variation threshold;

indicating a potential solenoid electrical connection fault if the solenoid current feedback is less than the predetermined low current threshold and less than the predetermined variation threshold; and indicating a potential solenoid weakened electromagnetic field fault if the solenoid current feedback is greater than the predetermined variation threshold.

2. The method of claim 1, wherein the step of determining a solenoid current feedback includes determining a mean of the solenoid current feedback, the method further comprising:

determining whether the mean is greater than a predetermined high current threshold; and indicating the potential solenoid weakened electromagnetic field fault if the mean is greater than the predetermined high current threshold.

3. The method of claim 2, wherein the step of determining the solenoid current feedback includes measuring an amount of current flowing through the fuel pump control solenoid at a range of operating conditions and normalizing the amount of current flowing through the fuel pump control solenoid against the range of operating conditions.

4. The method of claim 3, further comprising:

determining a plurality of control signal adjustment gain values applied to a control signal for controlling the fuel pump control solenoid at the range of operating conditions;

normalizing the plurality of control signal adjustment gain values against the range of operating conditions to define a set of normalized control signal adjustment gain values;

indicating a deviating control signal adjustment if any normalized control signal adjustment gain value of the set of normalized control signal adjustment gain values lies outside of a predetermined desired gain range;

indicating a normal control signal adjustment if the set of normalized control signal adjustment gain values lies inside of the predetermined desired gain range; and indicating a potential bad current sensing fault if the normal control signal adjustment is indicated and at least one of the potential solenoid electrical connection fault and the potential solenoid weakened electromagnetic field fault is indicated.

5. The method of claim 4, further comprising energizing the fuel pump control solenoid to hold the fuel pump control solenoid closed during a hold timeframe and deenergizing the fuel pump control solenoid to begin a solenoid off timeframe, wherein the step of determining the solenoid current feedback is performed at one of the following times: a) at the start of the solenoid off timeframe; and b) during the hold timeframe.

6. The method of claim 5, further comprising:

issuing a potential solenoid electrical connection fault warning message if the potential solenoid electrical connection fault is indicated;

issuing a potential solenoid weakened electromagnetic field fault warning message if the potential solenoid weakened electromagnetic field fault is indicated; and issuing a potential bad current sensing fault warning message if the potential bad current sensing fault is indicated.

7. A fuel delivery system comprising:

a fuel pump having a pumping chamber and a closeable inlet valve;

a fuel rail configured to communicate pressurized fuel received from the fuel pump to at least one engine cylinder; and a control system comprising a memory and an instruction set, the instruction set executable to:

determine a current feedback of the closeable inlet valve;

determine whether the current feedback is less than a predetermined low current threshold;

determine a magnitude of variation of the current feedback;

determine whether the magnitude of variation of the current feedback exceeds a predetermined variation threshold;

indicate a potential valve electrical connection fault if the current feedback is less than the predetermined low current threshold and less than the predetermined variation threshold; and indicate a potential valve weakened electromagnetic field fault if the current feedback is greater than the predetermined variation threshold.

8. The fuel delivery system of claim 7, wherein the control system is further configured to:

determine a mean of the solenoid current feedback;

determine whether the mean is greater than a predetermined high current threshold; and indicate the potential solenoid weakened electromagnetic field fault if the mean is greater than the predetermined high current threshold.

9. The fuel delivery system of claim 8, wherein the control system is configured to determine the current feedback by determining an amount of current flowing through the closeable inlet valve at a range of operating conditions and normalizing the amount of current flowing through the closeable inlet valve against the range of operating conditions.

10. The fuel delivery system of claim 9, the control system being configured to:

determine a plurality of control signal adjustment gain values applied to a control signal for controlling the closeable inlet valve at the range of operating conditions;

normalize the plurality of control signal adjustment gain values against the range of operating conditions to define a set of normalized control signal adjustment gain values;

indicate a deviating control signal adjustment if any normalized control signal adjustment gain value of the set of normalized control signal adjustment gain values lies outside of a predetermined desired gain range;

indicate a normal control signal adjustment if the set of normalized control signal adjustment gain values lies inside of the predetermined desired gain range; and indicate a potential bad current sensing fault if the normal control signal adjustment is indicated and at least one of the potential solenoid electrical connection fault and the potential solenoid weakened electromagnetic field fault is indicated.

11. The fuel delivery system of claim 10, wherein the control system is configured to determine the current feedback by calculating an average and a standard deviation of a difference between an actual current feedback signal and an expected current feedback signal.

12. The fuel delivery system of claim 10, the control system being further configured to energize the closeable inlet valve to hold the closeable inlet valve closed during a hold timeframe and deenergize the closeable inlet valve to begin a solenoid off timeframe, wherein the control system is configured to determine the current feedback at one of the following times: a) at the start of the solenoid off timeframe; and b) during the hold timeframe.

13. The fuel delivery system of claim 12, the control system being configured to: issue a potential solenoid electrical connection fault warning message if the potential solenoid electrical connection fault is indicated, issue a potential solenoid weakened electromagnetic field fault warning message if the potential solenoid weakened electromagnetic field fault is indicated, and issue a potential bad current sensing fault warning message if the potential bad current sensing fault is indicated.

14. The fuel delivery system of claim 13, further comprising a low-pressure supply pump configured to provide fuel to the fuel pump.

15. A direct-inject fuel pump prognosis system comprising a memory and an instruction set, the instruction set executable to:

determine a current feedback of a closeable inlet valve;

determine a mean current based on the current feedback;

determine whether one of the current feedback and the mean current is less than a predetermined low current threshold;

determine a magnitude of variation of the current feedback;

determine whether the magnitude of variation of the current feedback exceeds a predetermined variation threshold;

determining whether the mean current is greater than a predetermined high current threshold;

indicate a potential valve electrical connection fault if the current feedback is less than the predetermined low current threshold and less than the predetermined variation threshold; and indicate a potential valve weakened electromagnetic field fault if at least one of the following is true: a) the current feedback is greater than the predetermined variation threshold; and b) the mean current is greater than the predetermined high current threshold.

16. The direct-inject fuel pump prognosis system of claim 15, the direct-inject fuel pump prognosis system being configured to issue:

a potential solenoid electrical connection fault warning message if the potential solenoid electrical connection fault is indicated; and a potential solenoid weakened electromagnetic field fault warning message if the potential solenoid weakened electromagnetic field fault is indicated.

17. The direct-inject fuel pump prognosis system of claim 16, the direct-inject fuel pump prognosis system being configured to determine the current feedback by determining an amount of current flowing through the closeable inlet valve at a range of operating conditions and normalizing the amount of current flowing through the closeable inlet valve against the range of operating conditions.

18. The direct-inject fuel pump prognosis system of claim 17, the direct-inject fuel pump prognosis system being configured to:

determining a plurality of control signal adjustment gain values applied to a control signal for controlling the closeable inlet valve at the range of operating conditions;

normalize the plurality of control signal adjustment gain values against the range of operating conditions to define a set of normalized control signal adjustment gain values;

indicate a deviating control signal adjustment if any normalized control signal adjustment gain value of the set of normalized control signal adjustment gain values lies outside of a predetermined desired gain range;

indicate a normal control signal adjustment if the set of normalized control signal adjustment gain values lies inside of the predetermined desired gain range; and indicate a potential bad current sensing fault if the normal control signal adjustment is indicated and at least one of the potential solenoid electrical connection fault and the potential solenoid weakened electromagnetic field fault is indicated.

19. The direct-inject fuel pump prognosis system of claim 18, wherein the direct-inject fuel pump prognosis system is configured to determine the current feedback by calculating a standard deviation of a difference between an actual current feedback signal and an expected current feedback signal.

20. The direct-inject fuel pump prognosis system of claim 19, the direct-inject fuel pump prognosis system being further configured to energize the closeable inlet valve to hold the closeable inlet valve closed during a hold timeframe and deenergize the closeable inlet valve to begin a solenoid off timeframe, wherein the control system is configured to determine the current feedback at one of the following times: a) at the start of the solenoid off timeframe; and b) during the hold timeframe.

* * * * *